US005239284A

United States Patent [19]

Hara et al.

[11] Patent Number: 5,239,284

[45] Date of Patent: Aug. 24, 1993

[54] ANTITHEFT DEVICE

[75] Inventors: Iwao Hara, Osakasayama; Junji Higaki, Nara; Kohei Miyata, Sakai; Hiroshi Matsushima, Kobe, all of Japan

[73] Assignee: Kubota Corporation, Osaka, Japan

[21] Appl. No.: 803,321

[22] Filed: Dec. 4, 1991

[30] Foreign Application Priority Data

| | | | |
|---|---|---|---|
| Jan. 8, 1991 | [JP] | Japan | 3-86[U] |
| Jan. 8, 1991 | [JP] | Japan | 3-282 |
| Jan. 8, 1991 | [JP] | Japan | 3-283 |
| Jan. 8, 1991 | [JP] | Japan | 3-284 |
| Jan. 8, 1991 | [JP] | Japan | 3-285 |

[51] Int. Cl.[5] ..... G08B 1/08; G08B 13/14

[52] U.S. Cl. ..... 340/539; 340/571; 340/572; 340/568

[58] Field of Search ..... 340/539, 565, 567, 568, 340/571, 572, 573

[56] References Cited

U.S. PATENT DOCUMENTS

| | | | |
|---|---|---|---|
| 4,812,811 | 3/1989 | Asbrink et al. | 340/571 |
| 4,851,815 | 7/1989 | Enkelmann | 340/571 |
| 4,870,391 | 9/1989 | Cooper | 340/572 |
| 4,922,229 | 5/1990 | Guenst | 340/572 |
| 5,008,649 | 4/1991 | Klein | 340/572 |

*Primary Examiner*—Donnie L. Crosland
*Attorney, Agent, or Firm*—Joseph W. Farley

[57] ABSTRACT

An antitheft device of the type having a body unit to be attached to an article displayed in a shop for protecting the article against shoplifting. The device includes a transmitter for radiating an AC signal to a particular area, and the body unit which is adapted to receive a signal from the transmitter. The body unit comprises an alarm generator, and a receiving circuit operative to actuate the alarm generator in response to the signal from the transmitter. The transmitter radiates a feeble electromagnetic wave of less than 30 kHz corresponding to the sound range. The fact that the frequency of output from the transmitter is of a low frequency level corresponding to the sound range provides a greater allowance in the receiver for fluctuations in the frequency of signals received and thus good operation stability of the receiver. False alarming due to extraneous radiation is very unlikely to occur, and other components are free from the possibility of malfunctioning. In addition, the invention provides for compacturization of the receiver-side component or body unit.

5 Claims, 9 Drawing Sheets

ANTITHEFT DEVICE

FIELD OF THE INVENTION

The present invention relates to an antitheft device having a body unit attached to an article displayed in a store for protecting the article against shoplifting.

BACKGROUND OF THE INVENTION

In retail stores, such as disk selling stores, an antitheft device is used to protect articles, such as CD records, from shoplifting.

Where the article is a CD record, for example, the antitheft device comprises a body unit incorporating a battery-powered buzzer and a receiving circuit, with transparent acrylic plates attached to the body unit. The CD record, case-packed, is inserted into a storage space defined by the body unit and acrylic plates.

CD records, in such condition, are displayed in a disk store, and a customer who wants to buy such a CD record takes the CD record, with the body unit attached thereto, to the counter. Then, a clerk makes the body unit inoperative to sound an alarm by using a tool before the CD record is taken out from the storage space and handed to the customer.

If the CD record is taken out from the storage space without using the tool, the body unit operates to sounds an alarm. If an attempt is made to smuggle the CD record out of the store without having it taken out from the storage space, or with the body unit attached to the CD record, the receiving circuit senses a signal radiated from the transmitter exclusively to a particular area adjacent the doorway of the store to cause the buzzer to sound an alarm.

In known antitheft devices of this type, electromagnetic waves of VHF or UHF band are generally used for transmission of signals from the transmitter to the body unit.

However, the use of electromagnetic waves of such high frequency band presents several problems as mentioned below.

(1) The tuned frequency at the receiving circuit is likely to fluctuate, and because of large fluctuations involved, the receiving circuit has only limited allowance for frequency fluctuation of signals received.

(2) Misalarming is likely to occur due to extraneous radiation.

(3) Malfunction is likely to be caused to other equipment.

(4) There must be provided compensator means for eliminating problems (1) to (3) above, and because of the presence of the compensator means, the receiver portion of the body unit is necessitated to be of a large size.

SUMMARY OF THE INVENTION

Therefore, it is a primary object of the invention to provide an antitheft device which can overcome the foregoing problems without requiring any special compensator circuit.

In order to accomplish the above object, according to the present invention there is provided an antitheft device including a transmitter adapted to radiate an alternating current signal to a particular area, and a body unit attached to an article and capable of receiving the signal from the transmitter, said body unit having means for generating an alarm, and a receiving circuit for actuating the alarm generating means in response to the signal from the transmitter, wherein:

said transmitter is capable of radiating a feeble electromagnetic wave of less than 30 kHz corresponding to the sound range.

According to this arrangement, the transmitter radiates feeble electromagnetic waves of less than 30 kHz corresponding to the sound range and, therefore, the tuned frequency at the receiving circuit involves no large fluctuation, if any. This provides greater allowance for fluctuations in the frequency of signals received, as compared with that in the case of the known arrangement wherein the transmitter radiates electromagnetic waves of a high frequency band, and thus permits steady operation of the device. Misalarming due to extraneous radiation is very unlikely to occur, and there is no possibility of malfunction being caused to other equipment. Furthermore, no compensator means is required to prevent misalarming and/or malfunction of other equipment, which fact leads to an added advantage that the body unit at the receiver side can be compacted.

DESCRIPTION OF THE PREFERRED EMBODIMENTS

Figure 5:
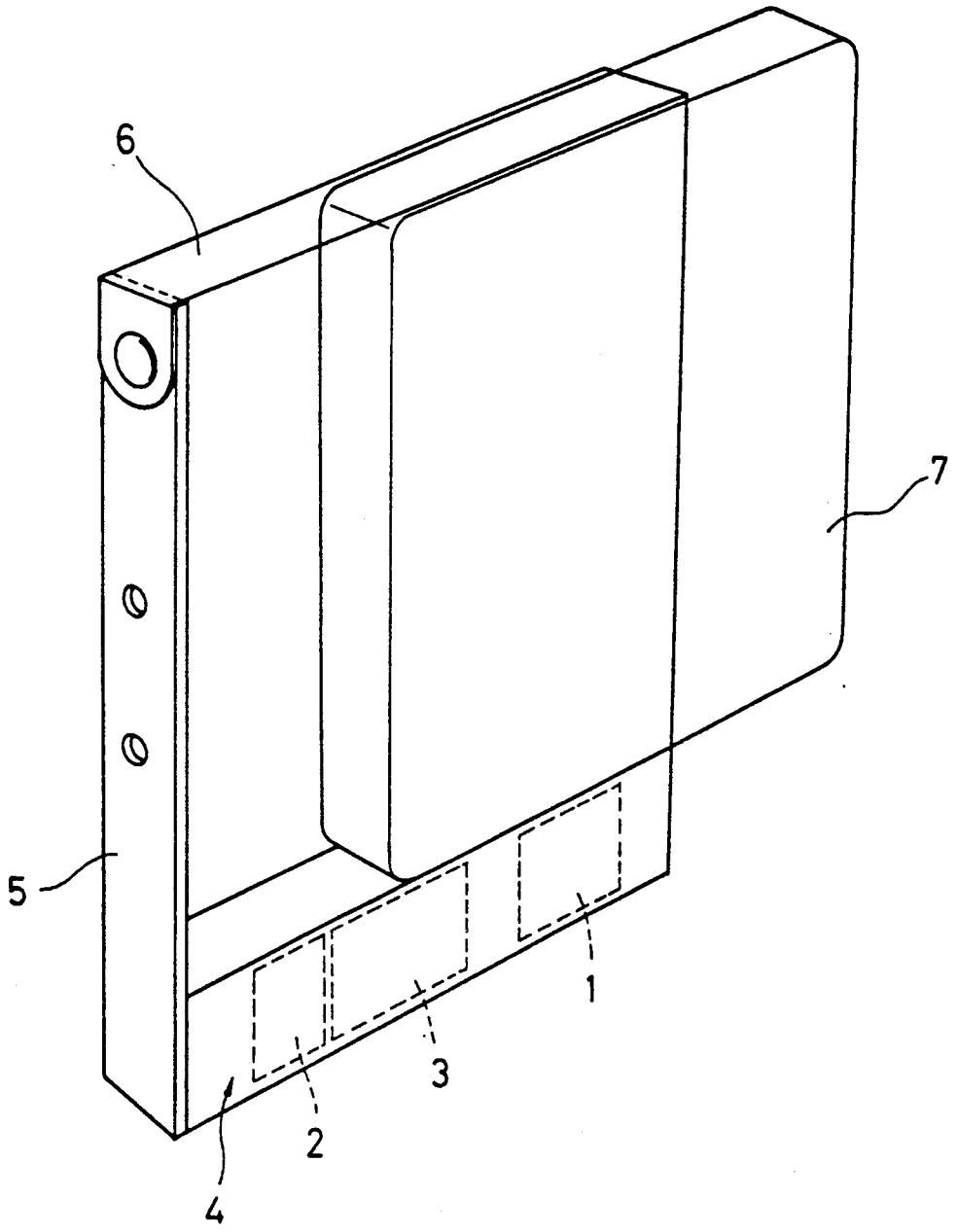
FIG. 5 is an enlarged view showing the body unit and adjacent fitments in FIG. 1.
Figure 6:
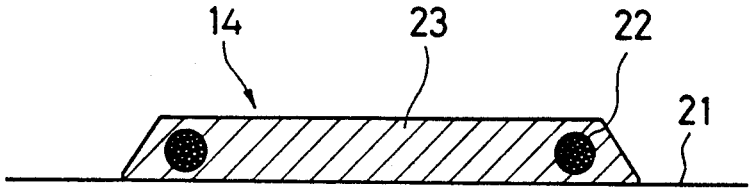
FIG. 6 is a cross-sectional view of the antenna in FIG. 1.
Figure 7:
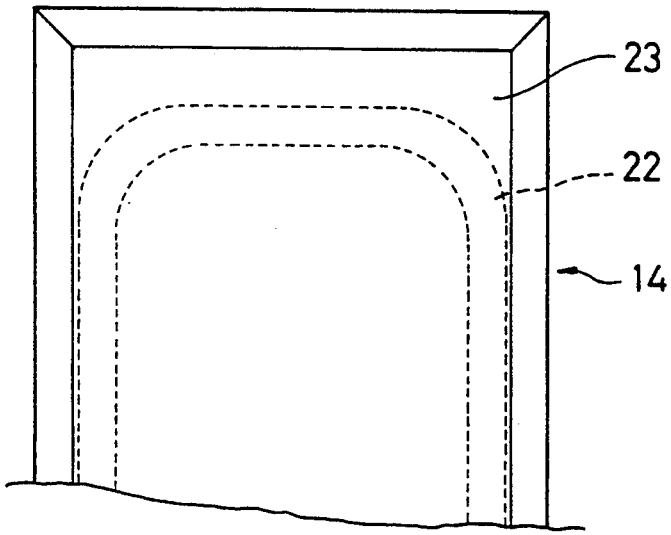
FIG. 7 is a plan view of the antenna in FIG. 6.

Referring first to FIG. 5, a body unit designated by reference numeral 4 incorporates a battery 1, and a buzzer 2 and a receiving circuit 3 which are powered by the battery 1. A back plate 5 and a transparent acrylic plate 6 bent into a box shape are attached to the body unit 4 with a double coated adhesive tape or the like. A case-packed CD record 7 is inserted into a storage space defined by the body unit 4, back plate 5, and acrylic plate 6.

Figure 1:
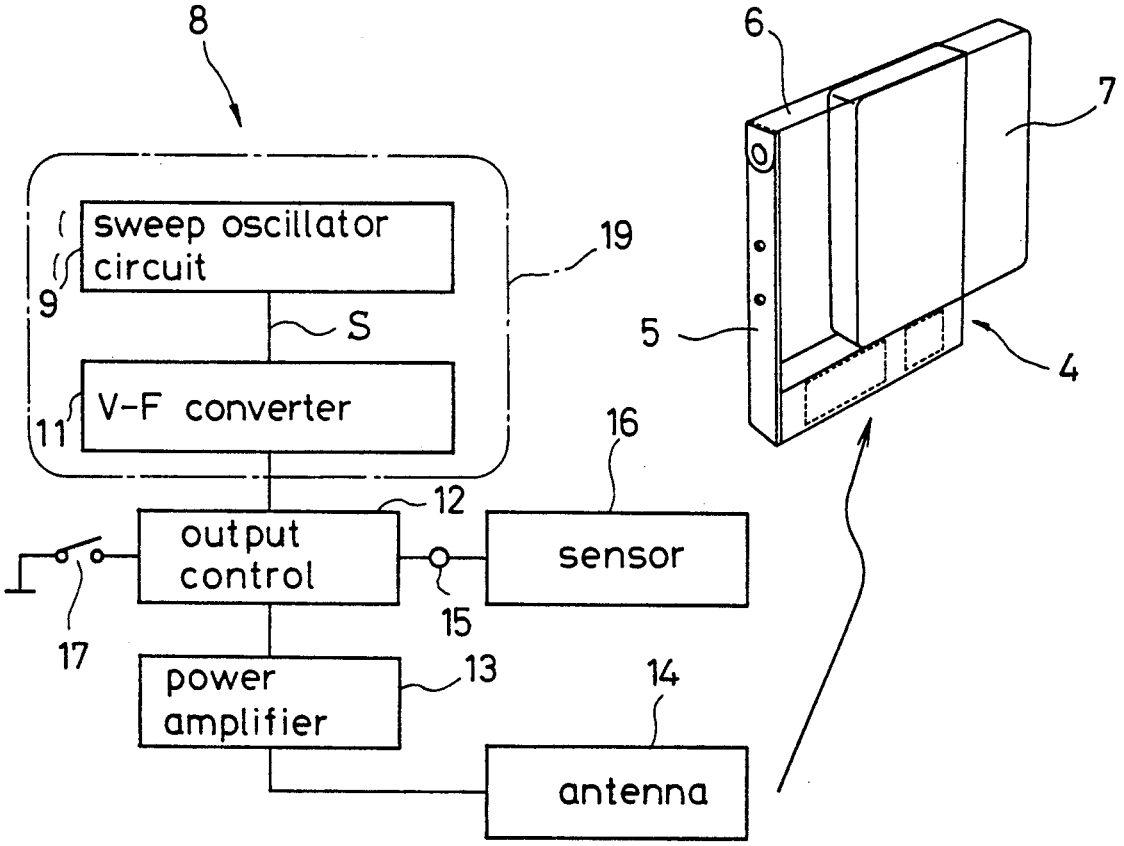
FIG. 1 is a view showing the arrangement of one embodiment of the antitheft device according to the invention.
Figure 2:
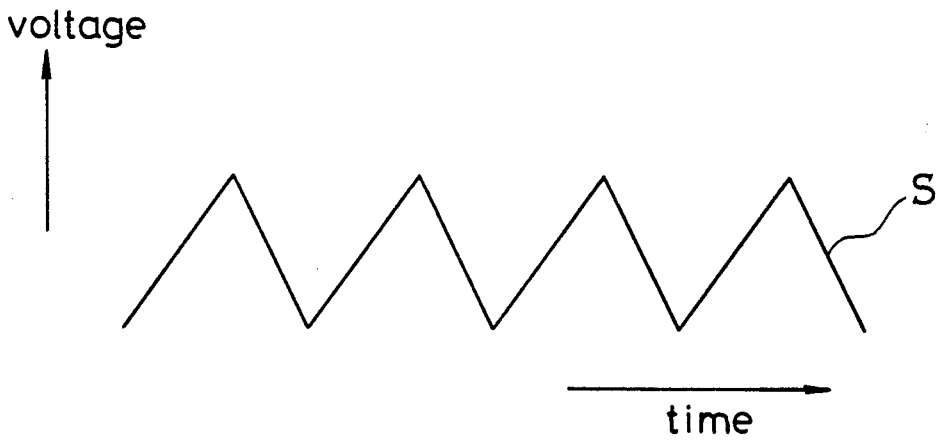
FIG. 2 is a diagram showing the wave form of output from the sweep oscillator circuit in FIG. 1.
Figure 3:
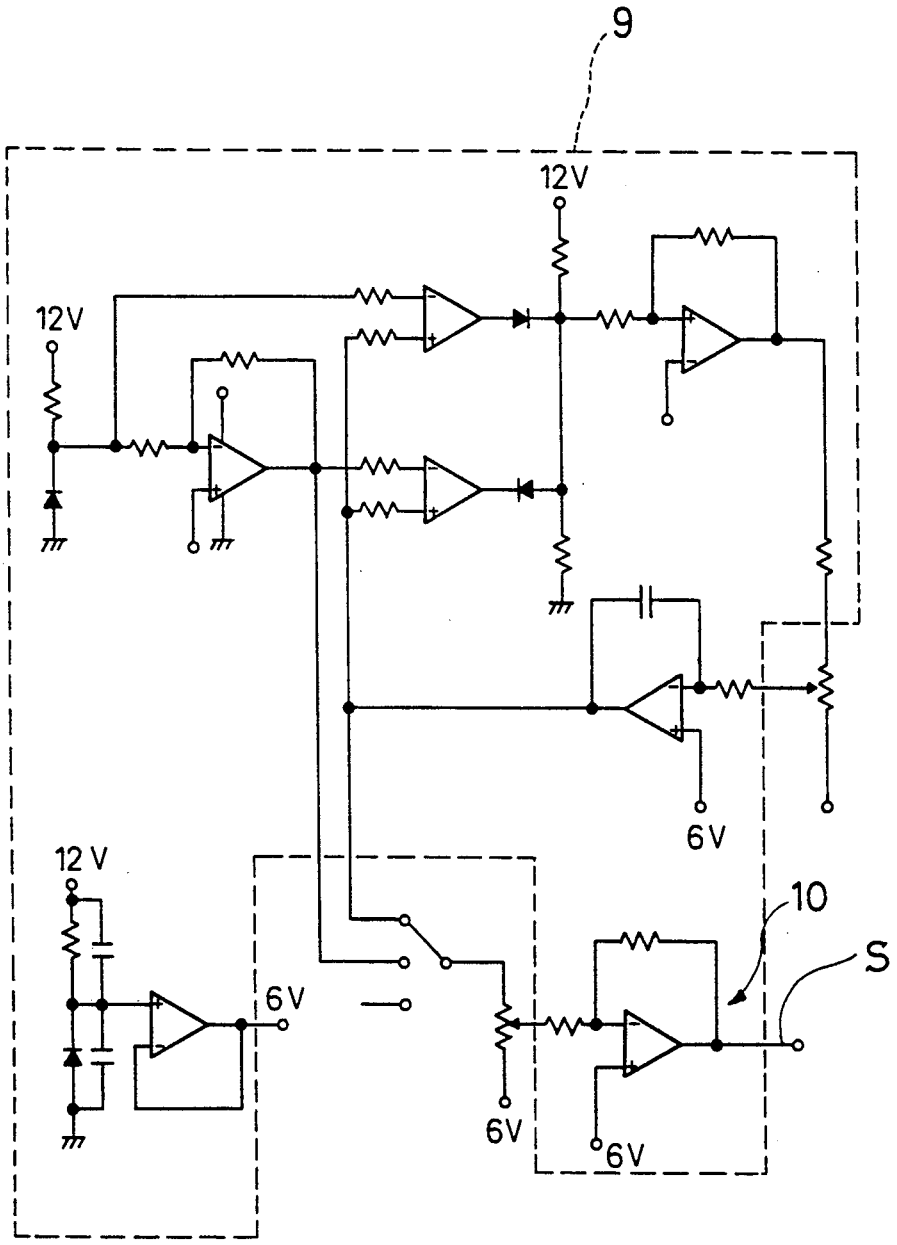
FIG. 3 is a circuit diagram showing the sweep oscillator circuit in FIG. 1.
Figure 4:
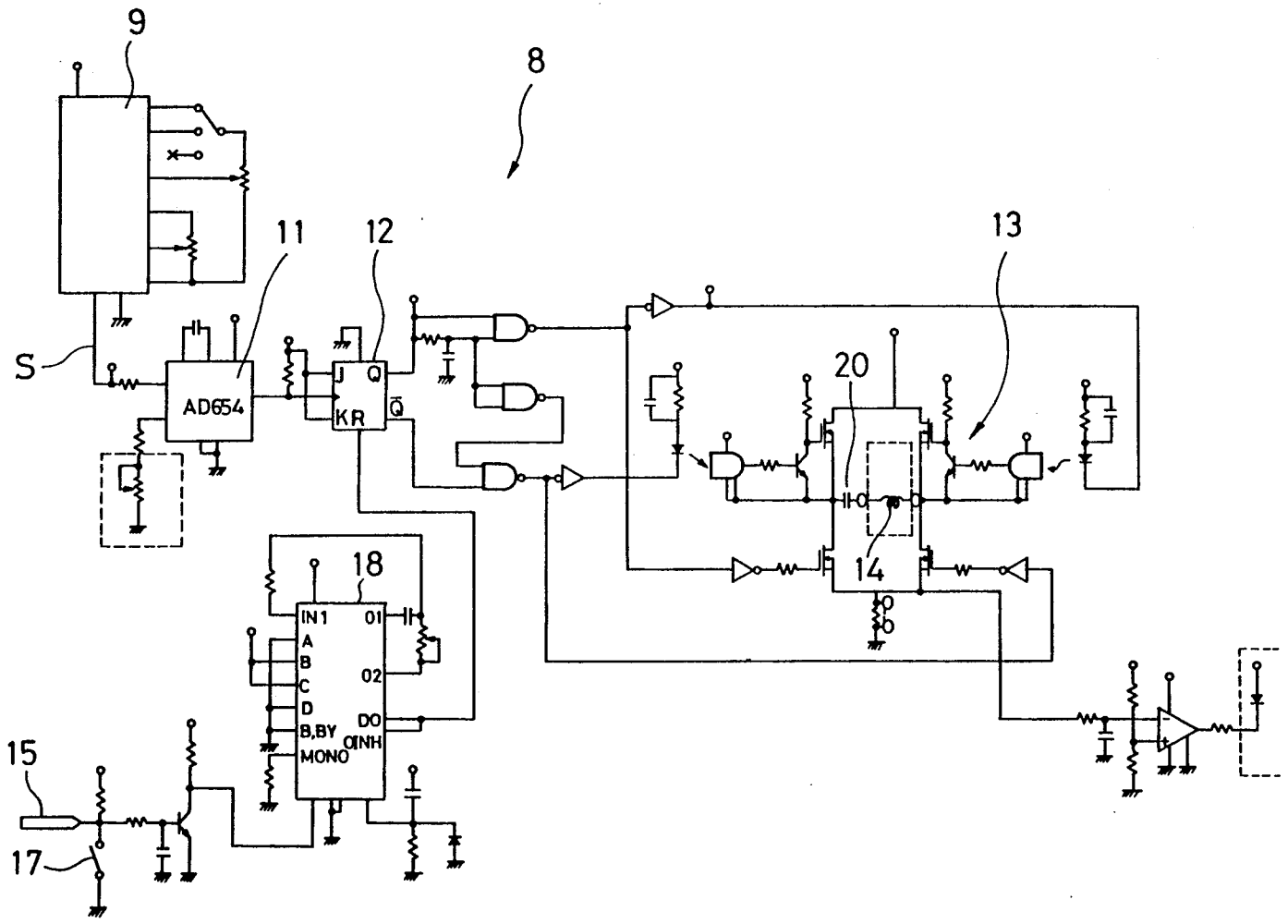
FIG. 4 is a circuit diagram with respect to the transmitter in FIG. 1.

As shown in FIGS. 1 and 4, a transmitter 8 of the antitheft device according to the invention has a signalling source 19 including a sweep oscilator circuit 9. An output signal S from the sweep oscillator circuit 9, as FIG. 2 shows, is a series of triangular waves repetitively generated in which the output voltage varies with time. FIG. 3 is a circuit diagram showing one form of the sweep oscillator circuit 9. Signal S is output through a buffer 10.

Output signal S from the sweep oscillator circuit 9 is converted into a rectangular wave of a repetition frequency corresponding to the input voltage by a voltage-frequency converter (made by Analog Devices, Model AD 654), and the converted signal is input in its rectangular wave form to a power amplifier 13 through an output control 12 made up of a J-K flip flop (digital IC, Model 4027) and the like so as to be amplified as such.

In FIG. 1, reference numeral 14 designates a loop-coil type antenna which is connected to the power amplifier 13 through a capacitor 20 as shown in FIG. 4. It is arranged that the resonance frequency which is determined by both the inductance of the antenna 14 and the capacitance of the capacitor 20 corresponds with the transmission frequency. The transmission frquency is set lower than 30 kHz or a frequency corresponding to the sound range (low frquency range). When the frequency is swept according to the output signal from the sweep oscillator circuit 9, a signal of a pseudo-sine wave form is radiated in the form of a feeble electromagnetic wave from the loop-coil type antenna 14 to an area adjacent the doorway of the store.

An infrared pyroelectric sensor 16 for sensing the approach of a person is connected to a terminal 15 of the output control 12. When the approach of a person to a location adjacent the doorway of the store is detected by the sensor 16, a monostable multivibrator (digital IC, Model 4536) 18 is actuated and, for a predetermined period of time after detection by the sensor 16 of the person's approach, a signal from the output of the voltage-frquency converter 11 is input to the power amplifier 13. When signals are to be successively radiated from the antenna 14 irrespective of the approach of a person or otherwise, a switch 17 is turned on.

The tuned frequency at the receiving circuit 3 of the body unit 4 is set approximately at the center frequency of the output frequency band being swept of the transmitter 8.

Since a feeble electromagnetic wave of lower than 30 kHz corresponding to the sound range within a low frequency band is radiated from the antenna 14 as stated above, the tuned frequency at the receiving circuit involves no more than a minor fluctuation if any, and this affords greater allowance for fluctuations in the frequency of signals received, as compared with the case in which the transmitter radiates electromagnetic waves of a high frequency band, and thus permits steady operation of the device. Therefore, the electromagnetic wave from the transmitter 8 can be positively received by the receiving circuit 3, and the buzzer 2 as alarm generating means can thus be caused to sound.

According to the invention, only through radiation of a feeble electromagnetic wave of lower than 30 kHz corresponding to the sound range, it is possible to provide such sufficient allowance for fluctuations in the frequency of received signals, and in addition by sweeping the output frequency of the transmitter 8 as aforesaid, it is possible to enable the receiving circuit 3 to positively sense signals from the transmitter 8 even if, in the course of operation of the device, the tuned frequency at the receiving circuit 3 should fluctuate in excess of the allowance.

The use of such a feeble electromagnetic wave of less than 30 kHz corresponding to the sound range makes it very unlikely that any misalarming due to extraneous radiation will occur, and involves no possible cause of malfunction of other equipment. Thus, the need for compensating means for prevention of any misalarming and/or malfunction of other equipment is eliminated, and this provides an additional advantage that the body unit 4 at the receiver side be compacted.

Since the power amplifier 13 is employed in amplifying rectangular waves, the power amplifier 13 is much more simple in construction than in the case where power of sine wave form is to be amplified, and this results in reduced power loss. Furthermore, radiation in space of pseudo-sine waves, and not rectangular waves, involves less spurious emission and provides quality signals.

FIGS. 6 to 9 illustrate the antenna 14 in detail. As shown, the antenna 14 is of a flat plate configuration and is laid on the floor 21 of a passage adjacent the doorway of the store. In some case, a cloth-made door mat is placed on the antenna 14.

As shown, the antenna 14 is such that a loop coil 22 as an antenna element is closely molded with a natural resin or natural rubber mat 23.

Figure 8:
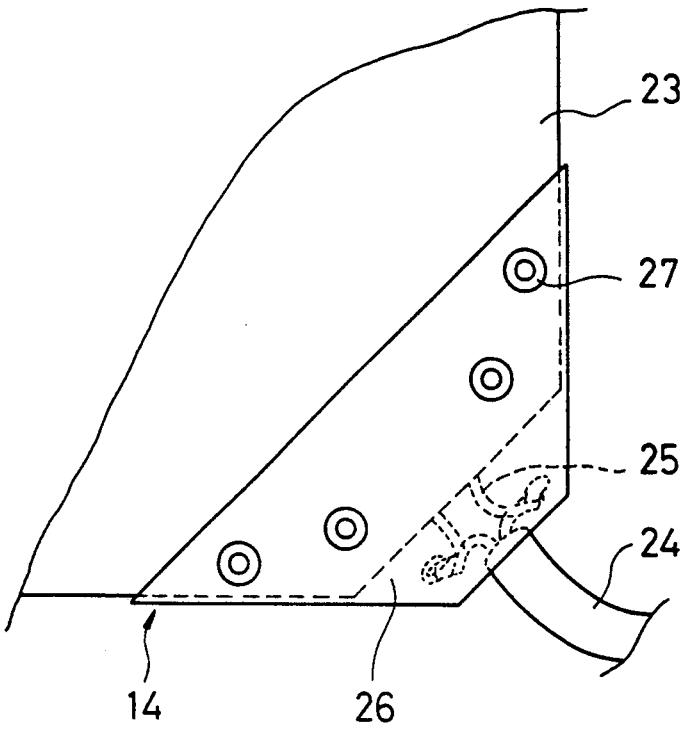
FIG. 8 is an enlarged plan view of a leader portion of the feeder line in the FIG. 7 antenna.
Figure 9:
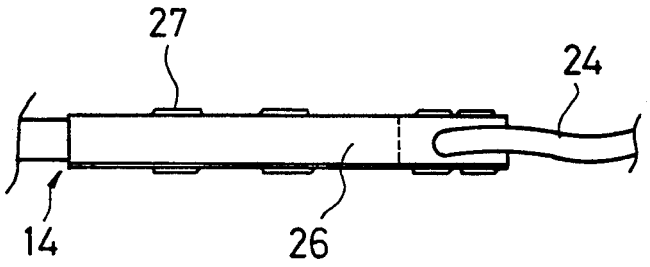
FIG. 9 is a side view of the leader portion in FIG. 8.

At a lead portion of the feeder line 24 which interconnects the loop coil 22 and the transmitter 8, as shown in FIGS. 8 and 9, a corner of the antenna 14 is configured to be obliquely cut off, with wires 25 drawn from the loop coil 22 for connection to the feeder line 24. For the purpose of protecting the connection, a metallic cap 26 is fitted on the cut-off portion, the cap 26 and mat 23 being integrally caulked by means of metallic fitments 27.

According to such arrangement, the loop coil 22 is covered with natural rubber mat 23 and, therefore, external force exerted on the mat 23 by the mat 23 being stepped on by a person or persons passing over the antenna does not concentrate on one spot but is dispersed to act on the loop coil 22. Therefore, even if the mat 23 is of relatively thin construction, the loop coil 22 can be satisfactorily protected.

Since the antenna 14 is such that the loop coil 22 is flatly molded with natural rubber mat 23, the antenna 14 can be transported in a cylindrically rolled condition and thus in a compact form.

In the foregoing example, the loop coil 22 is flatly molded with natural rubber mat 23, but in another form the mat 23 as a molding material may be of synthetic resin, e.g., synthetic rubber, instead of natural rubber. It is also possible to construct the antenna by compression-molding wood chips into a flat plate-shaped mat and embedding the loop coil into the mat for being molded into shape. Such construction can be employed with similar effect. Generally, the material with which the loop coil is molded may be a material which involves no or little attenuation of the electromagnetic wave or magnetic line of force radiated from the loop coil.

In the foregoing example, the body of the antenna is loop coil 22; however, it is noted that the type of the antenna is suitably selected according to the frequency of signals.

Figure 10:
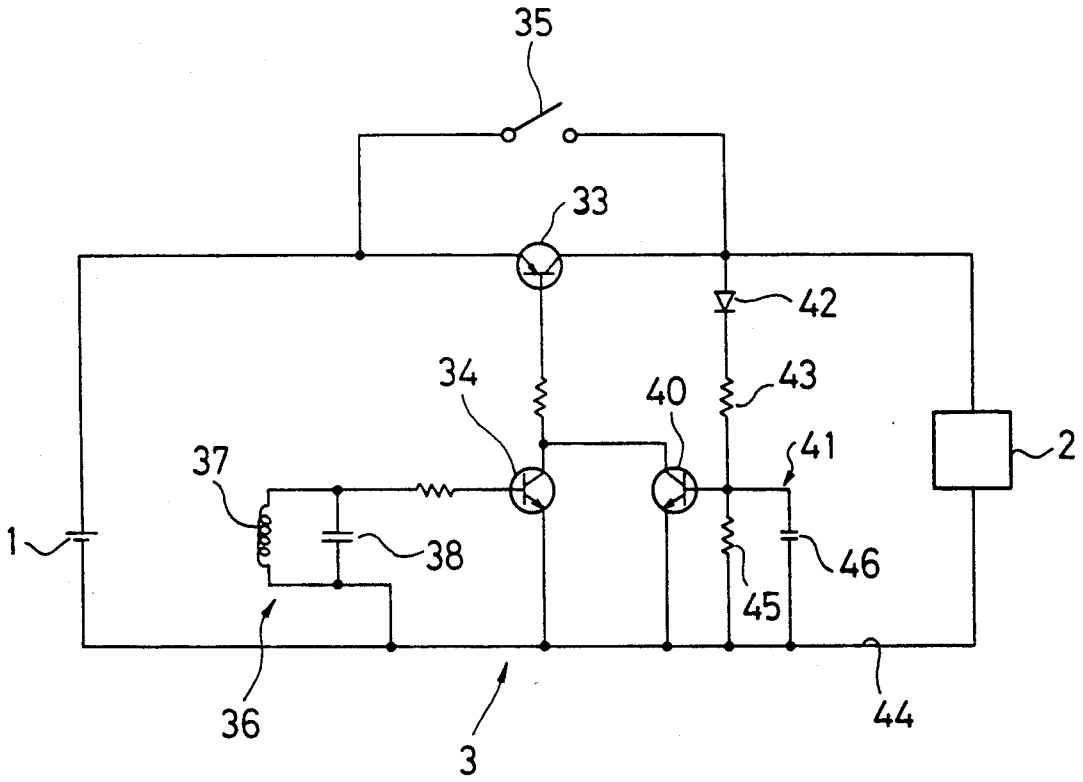
FIG. 10 is a circuit diagram showing by way of example a receiving circuit in the body unit of the antitheft device embodying the invention.

FIG. 10 shows one example of receiving circuit 3 of the body unit 4. A transistor 33 for switching operation is disposed between the battery 1 and the buzzer 2, and another transister 34 is connected to the base of the transistor 33 which constitutes a control terminal. Shown at 35 is a switch which detects the body unit 4 being unrightfully separated from the article or CD record 7. Reference numeral 36 designates a receiving region which consists of a coil 37 and capacitor 38, the output of the receiving region being connected between the base and emitter of the transistor 34.

The collector and emitter of a third transistor 40 are connected in parallel to the collector and emitter of the transistor 34. The collector voltage of the transistor 33 is applied to the base, as control terminal, of the transistor 40 through a diode 42 and a resistance 43. A time constant circuit 41 consisting of a resistance 45 and a capacitor 46 is connected between the base of the transistor 40 and a reference voltage section 44.

When a customer attempts to take a CD record to which is attached the body unit 4 out of the store, the output voltage level at the receiving section 36 rises during the time when a signal radiated from the transmitter in the vicinity of the doorway of the store is interlinking with the coil 37, and meanwhile the transistor 34 modulates the base current of the transistor 33, so that power is fed from the battery 1 to the buzzer 2 via the transistor 33 to sound the buzzer 2.

As the signal from the transmitter 8 ceases from interlinking with the coil 37, the output voltage of the receiving region 36 is lowered to bring the transistor 34 to an off condition. However, since the time constant of the time constant circuit 41 is set shorter than a normal period of time in which the signal from the transmitter 8 is interlinking with the coil 37, the potential at the base of the transistor 40 rises sufficiently while the transistor 33 is in conducting state. Accordingly, the transistor 40 conducts and current continues to be supplied to the base of the transistor 33 when the transistor 34 goes into off condition, the transistor 33 being thus maintained in conducting state. Therefore, the buzzer 2 continues sounding to give the alarm that an unrightful act has occurred.

While the body unit 4 may be subject to extraneous noise, the time constant of the time constant circuit 41 is set longer than the pulse width of the extraneous noise. Therefore, even when, because of the extraneous noise, the output voltage at the receiving region 36 rises and the transistor 34 goes into on condition, the potential at the base of the transistor 40 does not rise enough to bring the transistor 40 into conducting state. Accordingly, the transistor 40 is maintained in its off condition irrespective of the presence of extraneous noise or otherwise.

In this case, therefore, the transistor 33 returns to its off condition along with the inversion to off condition of the transistor 34, and power supply to the buzzer 2 is stopped, with the result that malfunctioning such as continual buzzer 2 sounding is prevented.

Figure 11:
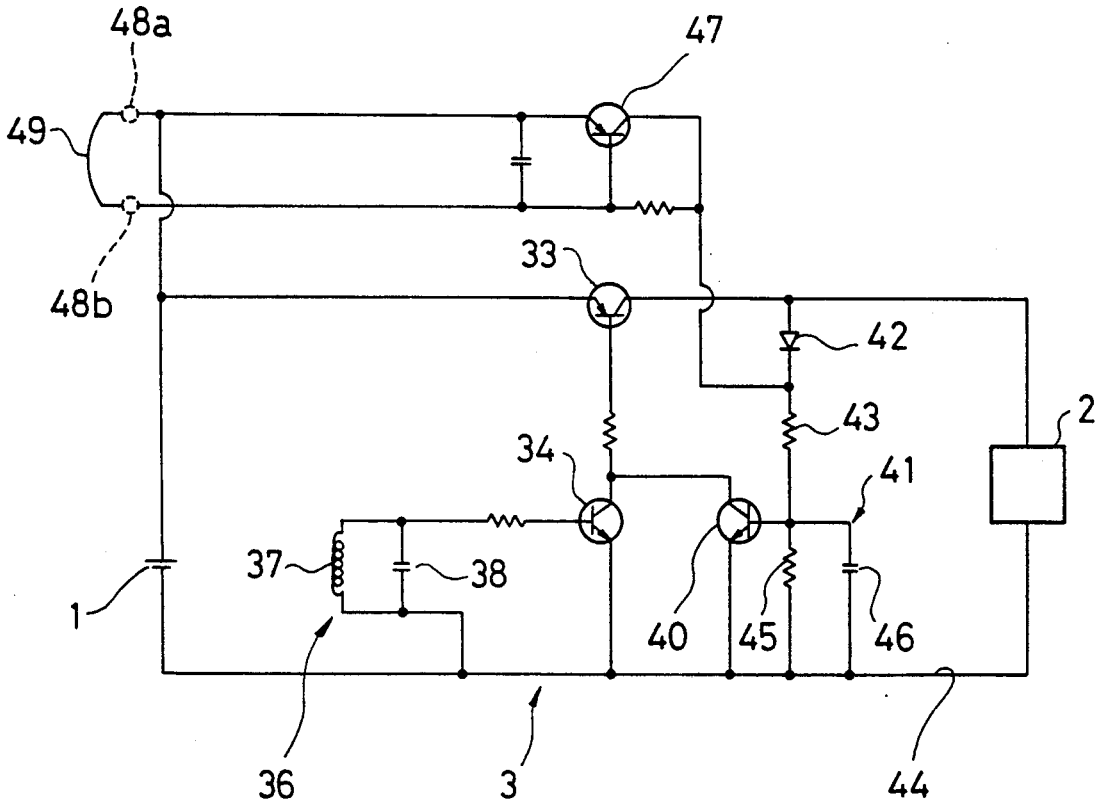
FIG. 11 is a circuit diagram showing another example of the receiving circuit.

FIG. 11 shows a modified form of the receiving circuit 3 shown in FIG. 10. The antitheft device shown in FIGS. 1 through 10 is suitable for application to articles, such as CD record, which are suitable for being housed in a storage space defined by the unit body 4 and acrylic plate 6. However, some articles, such as wearing apparels, are unsuitable for being housed in such a storage space. In the case of such article, it is a common practice that the body unit 4 is attached to the article with a conductive tag cord.

The antitheft device having such form of receiving circuit 3 as shown in FIG. 11 is suitable for utilization of such tag cord. More particularly, the body unit of the antitheft device is attached to the article by means of a conductive tag cord 49, and the receiving circuit 3 incorporates a transistor 47 for detecting any unrightful removal of the tag cord 49.

For the purpose of attaching the receiving circuit 3 to the article by means of tag cord 49, methods such as snap fastening, pressing against the electrode by means of a presser member, and clasping with a springy electrode may be advantageously employed, as described in Japanese Patent Application Laid-Open Publication No. 2-14398.

In the FIG. 11 example, the body unit is attached to the article by snap joints 48*a*, 48*b* through a tag cord 49, and it is arranged that the conduction between the snap joints 48*a* and 48*b* is detected by transistor 47. When the snap joints 48*a* and 48*b* are in conduction with each other via tag cord 49, the collector potential of the transistor 47 is at "L" level. The collector of the transistor 47 is connected to a connecting point between diode 42 and resistance 43 at the base side of the transistor 40.

When one who attempts to remove the body unit attached to the article and take out same unrightfully severs the tag cord 49 or disengages the snap joints 48*a*, 48*b*, the collector potential of the transistor 47 is inverted to "H" level. Therefore, the base potential of the transistor 40 rises high enough to bring the transistor 40 to its on condition, so that the transistor 33 goes into conducting state to sound the buzzer 2.

In the case where some temporary poor contact condition occurs with the tag cord 49 at snap joint 48*a* or 48*b*, an "H" level pulse of shorter width than the time constant of the time constant circuit 41 occurs at the collector of the transistor 47. In this case, under the function of the time constant circuit 41, the base potential of the transistor 40 is not allowed to rise high enough to bring the transistor 40 into conduction, and accordingly the transistor 40 is maintained in its off condition. Therefore, the transistor 33 is kept in its off condition, and any such malfunction as continual buzzer 2 sounding is effectively prevented.

What is claimed is:

1. An antitheft device including a transmitter adapted to radiate an alternating current signal to a particular area, and a body unit attached to an article and capable of receiving the signal from the transmitter; said body unit having means for generating an alarm, and a receiving circuit for actuating the alarm generating means in response to the signal from the transmitter; wherein:

said transmitter is capable of radiating a feeble electromagnetic wave of less than 30 kHz corresponding to an audio frequency range;

said transmitter having means for varying the transmission frequency of the transmitter with time by sweeping a frequency band including frequencies at which a signal can be received by said receiving circuit; and said means for varying the transmission frequency including means for repetitively outputting a triangular wave which varies the output voltage with time, and means for effecting voltage-to-frequency conversion of the triangular wave.

2. An antitheft device as set forth in claim 1, further comprising:

means for detecting a person coming near the transmitter, and means for causing the transmitter to radiate a signal for a predetermined period of time after the detection of the person by the detecting means.

3. An antitheft device as set forth in claim 1, further comprising:

means for generating a rectangular wave as an alternating current signal within the transmitter, means for power amplification of the rectangular wave, means for converting the amplified signal into a pseudo-sine wave, and means for outputting the converted signal from an antenna.

4. An antitheft device including a transmitter adapted to radiate a signal to a particular area, and a body unit attached to an article and capable of receiving the signal from the transmitter, said body unit comprising:

means for receiving the signal from said transmitter, means for generating an alarm, a power supply for driving the alarm generating means, first switch means interposed in series between said alarm generating means and said power supply, second switch means operative to turn on said first switch means while said signal receiving means is receiving a signal, third switch means arranged in parallel with said second switch means and having a control terminal, said third switch means being operative to turn on said first switch means when a voltage existing between said first switch means and said alarm generating means is applied to said control terminal, and a time constant circuit connected to the control terminal of said third switch means and having a time constant which is shorter than the time interval of signal transmission from said transmitter and longer than the time interval of extraneous noises.

5. An antitheft device as set forth in claim 4, wherein:

said body unit is tag-configured and attached to the article by means of a tag cord, said body unit has a pair of connecting portions to which are connected said tag cord at both end thereof, and said antitheft device has means for detecting the discontinuity of said pair of connecting portions when the connecting portions are disconnected from each other, and means for applying an output of said detecting means to said third switch means.

* * * * *

UNITED STATES PATENT AND TRADEMARK OFFICE

CERTIFICATE OF CORRECTION

PATENT NO. : 5,239,284

DATED : August 24, 1993

INVENTOR(S) : IWAO HARA et al.

It is certified that error appears in the above-identified patent and that said Letters Patent is hereby corrected as shown below:

Column 2, line 62, correct spelling of "oscillator"

Column 4, line 3, after "side" insert --can--

Column 4, line 61, correct spelling of "transistor"

Signed and Sealed this

Twenty-second Day of March, 1994

*Attest:*

Bruce Lehman

BRUCE LEHMAN

*Attesting Officer*

*Commissioner of Patents and Trademarks*